United States Patent [19]

Takahashi

[11] 3,982,069

[45] Sept. 21, 1976

[54] DECODING APPARATUS FOR USE IN MATRIX FOUR CHANNEL SYSTEMS OF A PLURALITY OF TYPES

[75] Inventor: Susumu Takahashi, Tokyo, Japan

[73] Assignee: Sansui Electric Co., Ltd., Tokyo, Japan

[22] Filed: Oct. 14, 1975

[21] Appl. No.: 622,173

[30] Foreign Application Priority Data

Oct. 16, 1974 Japan ..... 49-118898

[52] U.S. Cl. ..... 179/1 GQ; 179/100.1 TD; 179/100.4 ST

[51] Int. Cl.[2] ..... H04R 5/00

[58] Field of Search ... 179/1 GQ, 15 BT, 100.1 TD, 179/100.4 ST

[56] References Cited

UNITED STATES PATENTS

| | | | |
|---|---|---|---|
| 3,783,192 | 1/1974 | Takahashi | 179/1 GQ |
| 3,835,255 | 9/1974 | Bauer | 179/1 GQ |
| 3,856,992 | 12/1974 | Cooper | 179/1 GQ |
| 3,885,801 | 5/1975 | Ito et al. | 179/1 GQ |
| 3,887,770 | 6/1975 | Takahashi | 179/1 GQ |
| 3,934,086 | 1/1976 | Takahashi | 179/1 GQ |

*Primary Examiner*—Douglas W. Olms
*Attorney, Agent, or Firm*—Harris, Kern, Wallen & Tinsley

[57] ABSTRACT

A four channel decoding apparatus comprises means to form signals LT+RT, LT−RT, +jLT+RT; LT+RT, LT−RT; and LT+jRT, LT−jRT, for example, from composite signals LT and RT depending upon the type of the matrix four channel systems and means for additively and subtractively combining these sum and difference signals to produce four reproduced signals.

6 Claims, 3 Drawing Figures

DECODING APPARATUS FOR USE IN MATRIX FOUR CHANNEL SYSTEMS OF A PLURALITY OF TYPES

This invention relates to decoding apparatus suitable for use in matrix four channel systems of different types.

Recently various types of matrix four channel systems have been developed and some of them have been actually used. In order to reproduce four channel discs based on such a plurality of systems it is necessary to incorporate into a reproducing apparatus particular decoders appropriate for such systems. However, provision of a plurality of decoders appropriate for such systems of different types in a reproducing apparatus is extremely uneconomical.

Accordingly it is an object of this invention to provide an improved decoding apparatus for use in matrix four channel systems capable of reproducing composite signals based on a plurality of matrix systems by utilizing in common a majority of the circuit elements.

According to this invention there is provided a decoding apparatus for use in matrix four channel systems of different types comprising: first and second input terminals adapted to receive first and second composite signals respectively; first to fourth output terminals from which first to fourth output signals are derived out; first phase shifter circuit means coupled to said first input terminal for producing a third compositie signal; second phase shifter circuit means coupled to said second input terminal and having substantially the same phase shifting characteristic as said first phase shifter circuit means; matrix circuit means having first and second inputs, the second input of said matrix circuit means being coupled to said second input terminal of said decoding apparatus, said matrix circuit means being operative to produce a sum of input signals when they are applied to said first and second inputs of said matrix circuit means; first switch means coupled between said first input of said matrix circuit means and said first input terminal of said decoding apparatus for selectively coupling said first input terminal of said decoding apparatus to said first input of said matrix circuit means in accordance with the type of the first and second composite signals to be decoded; third phase shifter circuit means coupled to the output of said matrix circuit means and having a different phase shifting characteristic from said first and second phase shifter circuit means; second switch means for selectively deriving out an output signal from said second phase shifter circuit means and an output signal from said third phase shifter circuit means in accordance with the type of said first and second composite signals to be decoded to provide a fourth composite signal, said second switch means being adapted to selectively derive out the output signal from said second phase shifter circuit means as said fourth composite signal when said first switch means couples said first input terminal of said decoding apparatus to said first input of said matrix circuit means; and signal combining means adapted to generate first to fourth output signals on said first to fourth output terminals respectively by combining said third and fourth composite signals, when said first input terminal of said decoding apparatus is not coupled with said first input of said matrix circuit means and generate the first and second output signals on said first and second output terminals respectively by combining said third and fourth composite signals, and the third and fourth output signals on said third and fourth output terminals respectively by combining said third and fourth composite signals and a fifth composite signal which is produced by said third phase shifter circuit means when said first input terminal of said decoding apparatus is coupled to the first input of said matrix circuit means.

This invention can be more fully understood from the following detailed description when taken in conjunction with the accompanying drawings, in which.

Figure 1:
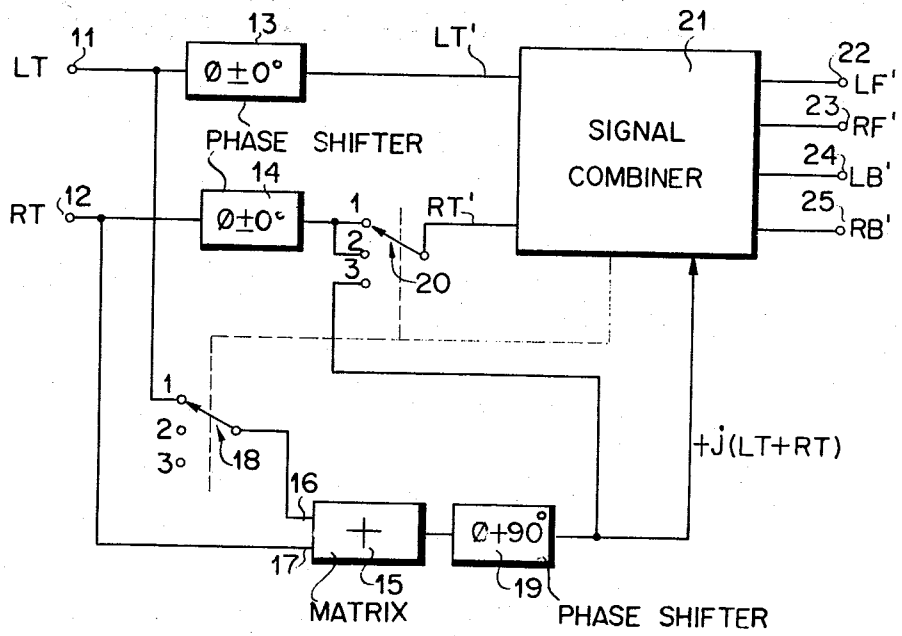
FIG. 1 is a block diagram showing one embodiment of the decoding apparatus of this invention.

Before describing the decoding apparatus of this invention three types of the system on which presently available matrix four channel discs are based will first be described.

At first, a type I system known as SQ system will be described.

Let us denote the left-front, left-back, right-front and right-back directional audio signals by LF, LB, RF and RB respectively. Then the left and right composite signals LT1 and RT1 encoded by the SQ system are expressed by the following equation.

$$\left.\begin{aligned} LT1 &= LF - j0.7LB + 0.7RB \\ RT1 &= RF + j0.7RB - 0.7LB \end{aligned}\right\} \quad (1)$$

where j represents a 90° phase shift.

The four channel reproduced signals LF1′, RF1′, LB1′ and RB1′ which are produced by decoding the composite signals LT1 and RT1 by a prototype decoder for the SQ system are expressed as follows.

$$\left.\begin{aligned} LF1' &= LT1 = LF - j0.7LB + 0.7RB \\ RF1' &= RT1 = RF + j0.7RB - 0.7LB \\ LB1' &= j0.7LT1 - 0.7RT1 = LB + j0.7LF - 0.7RF \\ RB1' &= -j0.7RT1 + 0.7LT1 = RB - j0.7RF + 0.7LF \end{aligned}\right\} \quad (2)$$

The composite signals LT2 and RT2 which are encoded by a type II system known as QS system are expressed as follows.

$$\left.\begin{aligned} LT2 &= LF + 0.4RF + jLB + j0.4RB \\ RT2 &= RF + 0.4LF - jRB - j0.4LB \end{aligned}\right\} \quad (3)$$

The four channel reproduced signals LF2′, RF2′, LB2′ and RB2′ which are obtained by decoding these composite signals with a prototype decoder for the QS system are expressed as follows.

$$\left.\begin{aligned} LF2' &= LT2 + 0.4RT2 = 1.17LF + 0.83RF + j0.83LB \\ RF2' &= RT2 + 0.4LT2 = 1.17RF + 0.83LF - j0.83RB \\ LB2' &= -j(LT2 - 0.4RT2) = 1.17LB + 0.83RF - j0.83LF \\ RB2' &= j(RT1 - 0.4LT1) = 1.17RB + 0.83LB - j0.83RF \end{aligned}\right\} \quad (4)$$

As a modification of the type II system shown by equation (3), there is an encoding system as follows.

$$\left.\begin{aligned} LT2 &= LF\angle{+22.5^\circ}+0.4RF\angle{-22.5^\circ}+LB\angle{+67.5^\circ}-0.4RB\angle{-67.5^\circ} \\ RT2 &= 0.4LF\angle{+22.5^\circ}+RB\angle{-22.5^\circ}-0.4LB\angle{+67.5^\circ}+RB\angle{-67.5^\circ} \end{aligned}\right\} \quad (5)$$

In each one of the systems expressed by equations (3) and (5), the composite signals LT2 and RT2 are in phase with respect to front signals LF and RF respectively, whereas the composite signals LT2 and RT2 are in the opposite phase with respect to back signals LB and RB. Accordingly, the composite signals LT2 and RT2 expressed by equation (5) can be reproduced by a decoder for the composite signals expressed by equation (3). In this manner, in a system wherein the left and right composite signals are substantially in phase with respect to the front signals whereas the composite signals are in the opposite phase with respect to the back signals it is possible to comonly use a decoder which produces four channel output signals by additive and subtractive combinations of the left and right composite signals as shown by equation (4).

In the composite signals LT2 and RT2 shown by equation (5), where audio signals LF, RF, LB and RB have the same phase and frequency, they have such phase relationships that LF leads RF by 45° in each of the composite signals LT2 and RT2, that LF and RF lag 90° from RB and LB respectively in the composite signal LT2, and that LF and RF lead RB and LB respectively by 90° in the composite signal RT2.

The composite signals LT3 and RT3 encoded by a type III system known as BMX system (see U.S. Pat. No. 3,856,992) are expressed as follows.

$$\left.\begin{aligned} LT3 &= LF\angle{+22.5^\circ}+0.4RF\angle{+67.5^\circ}+LB\angle{-22.5^\circ}+0.48RB\angle{-67.5^\circ} \\ RT3 &= 0.4LF\angle{-67.5^\circ}+RF\angle{-22.5^\circ}+0.4LB\angle{+67.5^\circ}+RB\angle{+22.5^\circ} \end{aligned}\right\} \quad (6)$$

The four channel output signals produced by decoding these composite signals LT3 and RT3 by a prototype decoder for the BMX system are expressed as follows.

$$\left.\begin{aligned} LF3' &= LT3\angle{-22.5^\circ}+0.4RT3\angle{+67.5^\circ} = 1.17LF+0.83RF\angle{+45^\circ}+0.83LB\angle{-45^\circ} \\ RF3' &= RT3\angle{+22.5^\circ}+0.4LT3\angle{-67.5^\circ} = 1.17RF+0.83LF\angle{-45^\circ}+0.83RB\angle{+45^\circ} \\ LB3' &= LT3\angle{+22.5^\circ}+0.4RT3\angle{-67.5^\circ} = 1.17LB+0.83RB\angle{-45^\circ}+0.83LF\angle{+45^\circ} \\ RB3' &= RT3\angle{-22.5^\circ}+0.4LT3\angle{+67.5^\circ} = 1.17RB+0.83LB\angle{+45^\circ}+0.83RF\angle{-45^\circ} \end{aligned}\right\} \quad (7)$$

In the type III system shown by equation (6) there is a relative phase difference of 90° between composite signals LT3 and RT3 with respect to each one of audio signals LF, RF, LB and RB. These audio signals have such relative phase relationship that, in each of the composite signals LT3 and RT3, RF leads LF by 45°, that in the composite signal LT3, LF and RF lead LB and RB respectively by 90°, and that in the composite signal RT3, LF and RF lag from RB and LB respectively by 90°. As a consequence, it is possible to make in phase two phase shifted composite signals LT3′ and RT3′ with respect to front audio signals LF and RF and to make these composite signals LT3′ and RT3′ to be opposite phases with respect to back audio signals LB and RB by, for example, lagging LT3 by 90° relative to RT3 or by advancing RT3 by 90° relative to LT3. It will thus be understood that the four channel output signals can be reproduced by applying the phase shifted composite signals LT3′ and RT3′ to a decoder for the type II system.

It is to be particularly pointed out that the amount of the phase shift imparted to respective signals shown in various equations described above is a relative value.

Preferred embodiments of the decoding apparatus of this invention will now be described with reference to the accompanying drawings. FIG. 1 shows a basic construction of the decoding apparatus of this invention in which reference numerals 11 and 12 designate first and second input terminals which may receive first and second composite signals LT and RT of respective types. The input terminal 11 is connected to a first reference phase shifter 13 which shifts the phase of the composite signal LT by a reference angle $\phi$. For the sake of description, the composite signal LT which has been phase shifted by the first phase shifter 13 is designated as a third composite signal LT′. A second reference phase shifter 14 is connected to the second input terminal 12 for shifting the phase of the composite signal RT. The second phase shifter 14 has the same phase shifting characteristic as the first phase shifter 13. There is provided a first matrix circuit 15 having first and second input terminals 16 and 17. The second input terminal 17 is connected directly to the second input terminal 12 whereas the first input terminal 16 is selectively connected to the first input terminal 11 through a single-pole triple-throw type first transfer switch 18 in accordance with the type of the composite signals to be decoded. Numerals 1, 2 and 3 assigned for three fixed contacts of the transfer switch 18 shown decoding positions for respective types I, II and III of matrix four channel systems as mentioned above. This is true for all transfer switches to be described later. Accordingly, the position of the movable contact of the transfer switch 18 shown in FIG. 1 corresponds to the decoding position for providing a four channel reproduction of the type I system. As shown, the first input 16 of the first matrix circuit 15 is connected to the first input terminal 11 only when the transfer switch 18 is thrown to the decoding position for effecting four channel reproduction of the type I system. Under these conditions the first matrix circuit 15 produces the sum (LT+RT) of the first and second composite signals LT and RT. When the transfer switch 18 is thrown to the decoding positions for reproducing other types II and III, the output of the matrix circuit 15 comprises only the composite signal RT.

The output from the first matrix circuit 15 is connected to a third phase shifter 19 having a +90° (+j) phase shifting characteristic with reference to the first and second phase shifters 13 and 14. A second transfer switch 20 selects either one of the outputs from the second and third phase shifters 14 and 19 depending upon the type of the composite signals to be decoded. The signal derived out by the second transfer switch 20 is herein termed a fourth composite signal RT′. As shown by dotted lines the first and second transfer switches 18 and 20 are interlocked with each other. When the second transfer switch 20 is thrown to the decoding position for type I or II system, the second composite signal RT phase shifted by the second phase shifter 14 is derived out as the fourth composite signal RT′ whereas when the switch 20 is thrown to the decoding position for the type III system the second composite signal RT phase shifted by the third phase shifter 19, that is +jRT is derived out as the fourth composite signal RT′. When both transfer switches 18 and 20 are thrown to the decoding position for the type I system the third phase shifter 19 produces an output +j(LT+RT) which is applied to a signal combiner 21 as a fifth composite signal.

When both transfer switches 18 and 20 are thrown to the decoding position for the type I system, the signal combiner 21 is adapted to produce four channel output signals LF′, RF′, LB′ and RB′ respectively on first to fourth output terminals 22 to 25 by suitably combining third, fourth and fifth composite signals LT′, RT′ and +j(LT+RT). On the other hand, when both transfer switches 18 and 20 are thrown to the decoding position for the type II system, the signal combiner 21 operates to produce output signals LF′, RF′, LB′ and RB′ by suitably combining the third and fourth composite signals LT′ and RT′. Further, when the transfer switches 18 and 20 are thrown to the decoding position for the type III system, first to fourth output signals LF′, RF′, LB′ and RB′ are produced by combining the third and fourth composite signals LT′ and RT′, that is LT and +jRT.

One example of the signal combiner 21 shown in FIG. 1 will now be described in detail with reference to FIG. 2, in which elements corresponding to those shown in FIG. 1 are designated by the same reference numerals and the description thereof is omitted. The second and third matrix circuits 26 and 27 are connected to receive the third and fourth composite signals LT′ and RT′ to respectively form a sum signal (LT′+RT′) and a difference signal (LT′−RT′). A fourth matrix circuit 28 is connected across the outputs of the second and third matrix circuits 26 and 27 for additively and subtractively combining the sum signal (LT′+RT′) and the difference signal (LT′−RT′) to produce front output signals LF′ and RF′ on the first and second output terminals 22 and 23. The fourth matrix circuit 28 comprises serially connected resistors 29 and 30 having an equal resistance value for performing additive operation, for example, with the juncture between resistors 29 and 30 connected to the first output terminal 22, resistors 31 and 32 having an equal resistance value and a phase inverter 33 which are connected in series, the juncture between resistors 31 and 32 being connected to the second output terminal 23.

A first amplitude level changing means 34 is connected between the output of the third matrix circuit 27 and an input of the fourth matrix circuit 28 for selectively changing the amplitude level of the difference signal (LT′−RT′) with respect to that of the sum signal (LT′+RT′) in accordance with the type of the composite signals LT and RT to be decoded. This means 34 comprises a voltage divider constituted by resistors 35 and 36 serially connected between the output of the third matrix circuit 27, and ground, and a third transfer switch 37 which is connected between the voltage divider and the fourth matrix circuit 28 and interlocked with the first and second transfer switches 18 and 20 as shown by dotted lines.

Figure 2:
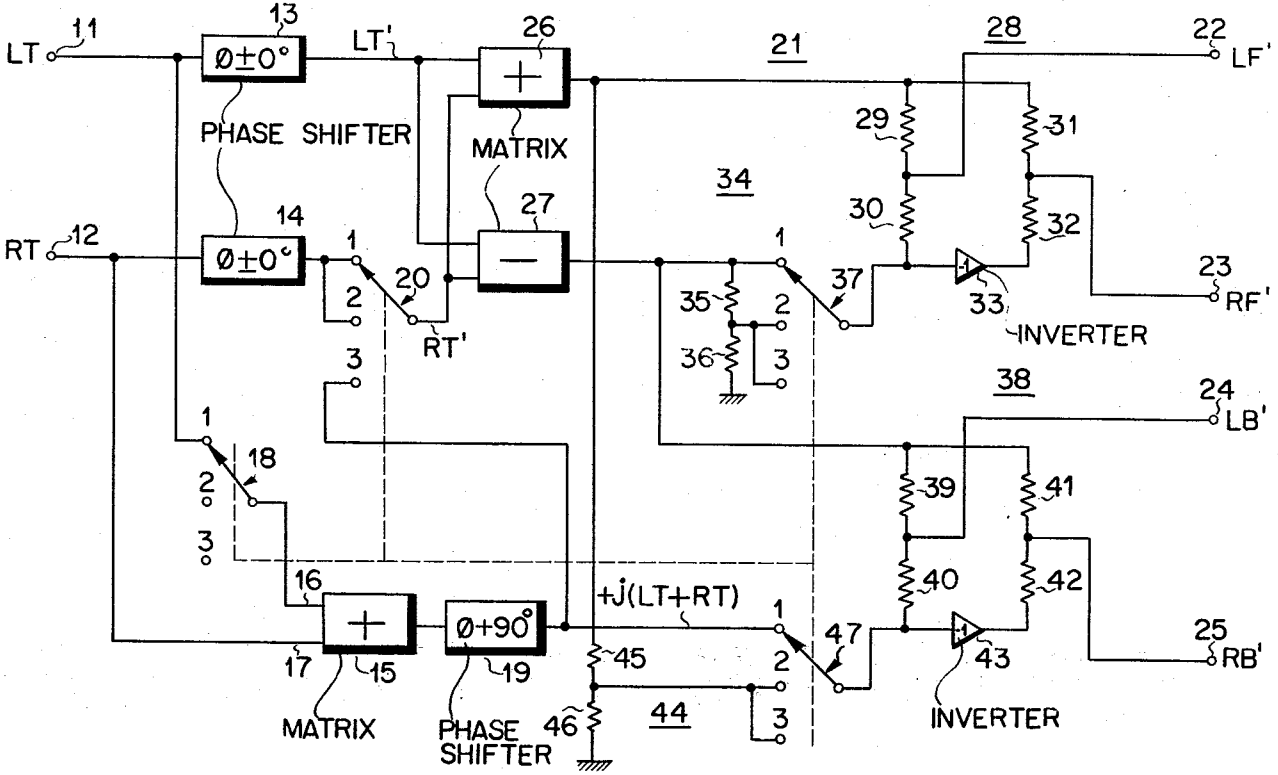
FIG. 2 is a connection diagram of one example of the signal combiner shown in FIG. 1.

As can be clearly noted from FIG. 2, when the third transfer switch 37 is thrown to the decoding position for the type I system, it directly couples the output difference signal (LT′−RT′) from the third matrix circuit 27 to the fourth matrix circuit 28 whereas when it is thrown to the decoding position for the type II and III systems a fraction of the output difference signal (LT′−RT′) from the third matrix circuit 27 is coupled to the fourth matrix circuit 28.

A fifth matrix circuit 38 is connected between the output of the second matrix circuit 26 and the output of either one of the third phase shifter 19 and the second matrix circuit 26 which is selected depending upon the type of the composite signals to be decoded for producing back output signals LB′ and RB′. The fifth matrix circuit 38 comprises serially connected resistors 39 and 40 for effecting addition and having an equal resistance value with their juncture connected to the third output terminal 24, resistors 41 and 42 and a phase inverter 43 which are connected in series for performing subtraction operation, resistors 41 and 42 having an equal resistance value and their juncture being connected to the fourth output terminal 25.

A second amplitude level changing means 44 is connected between the second matrix circuit 26 and the third phase shifter 19, and the fifth matrix circuit 38 for selectively changing the amplitude levels of the output sum signal (LT′+RT′) of the second matrix circuit 26 to be coupled to the fifth matrix circuit 38 in accordance with the type of the composite signals to be decoded, and of the fifth composite signal +j(LT+RT) from the third phase shifter 19 with respect to the amplitude level of the output difference signal (LT′−RT′) of the third matrix circuit 27 to be applied to the fifth matrix circuit 38. The second amplitude level changing means 44 comprises resistors 45 and 46 serially connected between the output of the second matrix circuit 26 and ground and a fourth transfer switch 47 which selectively couples the fifth composite signal +j(LT+RT) and a fraction of the sum signal (LT′−RT′) to an input of the fifth matrix circuit 38 in accordance with the type of the composite signals to be decoded. The fourth transfer switch 47 is interlocked with the first, second and third transfer switches 18, 20 and 37. As shown, when the transfer switch 47 is thrown to the decoding position for type I system it directly couples the fifth composite signal +j(LT+RT) from the third phase shifter to the fifth matrix circuit 38 whereas when it is thrown to the decoding position for the type II and III systems, it couples the fraction of the output sum signal (LT′+RT′) from the second matrix circuit 26 provided by the voltage dividing resistors 45 and 46 to the fifth matrix circuit 38.

The decoding apparatus shown in FIG. 2 operates as follows.

The four channel decoding operation for the type I system will first be described. In FIG. 2, the first to fourth transfer switches 18, 20, 37 and 47 are thrown to the decoding positions for the type I system. At this time, the sum signal (LT′+RT′), or (LT1−RT1) and the difference signal (Lt′−RT′), on (LT1−RT1) are supplied to the fourth matrix circuit 28 whereas the difference signal (LT1−RT1) and the fifth composite signal +j(LT1+RT1) are supplied to the fifth matrix circuit 38. Consequently, the front output signals LF′ and RF′ appearing on the first and second output terminals 22 and 23 are shown by the following equations.

$$LF' = \tfrac{1}{2}(LT1+RT1)+\tfrac{1}{2}(LT1-RT1) = LT1$$

$$RF' = \tfrac{1}{2}(LT1+RT1)-\tfrac{1}{2}(LT1-RT1) = RT1$$

It will be understood that these front output signals LF′ and RF′ are identical to those obtained by the prototype decoding apparatus for the type I system.

In the same manner, the back output signals LB′ and RB′ appearing on the third and fourth output terminals 24 and 25 are expressed by the following equations.

$$\begin{aligned} LB' &= \tfrac{1}{2}(LT1-RT1)+\tfrac{1}{2}j(LT1+RT1) = \\ &\tfrac{1}{2}\{LT1+jRT1-(RT1-jLT1)\} = \\ &\tfrac{1}{2}\{-j1.4LB+LF+jRF-(-1.4LB-jLF+RF)\} = \\ &\tfrac{1}{2}(2LB\angle{-45°}+1.4LF\angle{+45°}+1.4RF\angle{+135°}) = \\ &(LB+j0.7LF+0.7RF)\angle{-45°} \end{aligned}$$

$$\begin{aligned} RB' &= \tfrac{1}{2}(LT1-RT1)-\tfrac{1}{2}j(LT1+RT1) = \\ &\tfrac{1}{2}\{LT1-jRT1-(RT1+jLT1)\} = \\ &\tfrac{1}{2}(2RB\angle{-45°}+1.4RF\angle{-135°}+1.4LF\angle{-45°}) = \\ &(RB-j0.7RF+0.7LF)\angle{-45°} \end{aligned}$$

It will thus be clear that the back output signals LB′ and RB′ for the type I system are substantially identical to the back output signals shown by equation (2) and produced by the prototype decoding apparatus except that the signals LB′ and RB′ are phase shifted by −45°.

The four channel decoding operation for the type II system will now be considered. To this end the first to fourth transfer switches 18, 20, 37 and 47 are thrown to the decoding positions for the type II system. Under these conditions, the sum signal (LT′+RT′), that is (LT2+RT2) and a fraction of the difference signal f(LT′−RT′), that is f(LT2−RT2) are applied to the fourth matrix circuit 28, whereas the difference siganl (LT′−RT′), that is (LT2−RT2) and a fraction of the sum signal b(LT′+RT′), that is b(LT2+RT2) are applied to the fifth matrix circuit 38. The coefficients f and b are voltage division ratios which are expressed as R36/R35+R36) and R46/(R45+R46), respectively, where R35, R36, R45 and R46 represent the resistance values of resistors 35, 36, 45 and 46 respectively.

Accordingly, for the type II system, the front output signals LF′ and RF′ are expressed by the following equations.

$$\begin{aligned} LF' &= \tfrac{1}{2}\{LT2+RT2+f(LT2-RT2)\} = \\ &\tfrac{1}{2}(1+f)LT2+\tfrac{1}{2}(1-f)RT2 \end{aligned}$$

$$\begin{aligned} RF' &= \tfrac{1}{2}\{LT2+RT2-f(LT2-RT2)\} = \\ &\tfrac{1}{2}(1+f)RT2+\tfrac{1}{2}(1-f)LT2 \end{aligned}$$

Accordingly, if the coefficient f is selected to satisfy a relation $$(1+f):(1-f) = 1:0.4$$

or where $f$ is set to be about 0.4 the reproduced signals LF′ and RF′ are expressed by the following equations.

$$LF' = LT2 + 0.4RT2$$

$$RF' = RT2 + 0.4LT2$$

These reproduced signals are the same as the front reproduced signals expressed by equation (4).

The back output signals LB′ and RB′ are shown by the following equations.

$$\begin{aligned} LB' &= \tfrac{1}{2}\{LT2-RT2+b(LT2+RT2)\} = \\ &\tfrac{1}{2}(1+b)LT2-\tfrac{1}{2}(1-b)RT2 \end{aligned}$$

$$\begin{aligned} RB' &= \tfrac{1}{2}\{LT2-RT2-b(LT2+RT2)\} = \\ &-\{\tfrac{1}{2}(1+b)RT2-\tfrac{1}{2}(1-b)LT2\} \end{aligned}$$

Accordingly, in this case, if a relation $(1+b):(1-b) = 1:0.4$ is satisfied or if the voltage division ratio $b$ is selected to be equal to about 0.4 the reproduced signals LB′ and RB′ will be expressed as follows.

$$LB' = LT2-0.4RT2 = \{-j(LT2-0.4RT2)\}\angle{+90°}$$

$$RB' = -(RT2-0.4LT2) = \{j(RT2-0.4LT2)\}\angle{+90°}$$

It will thus be noted that the back reproduced signals LB′ and RB′ of the type II system are identical to the back output signals obtained by the prototype decoding apparatus and expressed by equation (4) except that the former signals are phase shifted by +90°.

Finally, the four channel decoding operation of type III system will be described. In this case, the first to fourth transfer switches 18, 20, 37 and 47 are thrown to the decoding positions for the type III system. Under these circumstances, the sum signal (LT′+RT′), that is (LT3+jRT3) and a fraction of the difference signal (LT′−RT′), that is $f$(LT3−jRT3) are applied to the fourth matrix circuit 28 whereas the difference signal (LT′−RT′), that is (LT3−jRT3) and a fraction of the sum signal (LT′+RT′), that is b(LT3+jRT3) are applied to the fifth matrix circuit 38.

Accordingly, in the type III system, the front output signals LF′ and RF′ are given by the following equations.

$$\begin{aligned} LF' &= \tfrac{1}{2}\{LT3+jRT3+f(LT3-jRT3)\} = \\ &\tfrac{1}{2}(1+f)LT3+\tfrac{1}{2}j(1-f)RT3 = LT3+j0.4RT3 = \\ &(LT3\angle{-22.5°}+0.4RT3\angle{+67.5°})\angle{+22.5°} \end{aligned}$$

$$\begin{aligned} RF' &= \tfrac{1}{2}\{LT3+jRT3-f(LT3-jRT3)\} = \\ &\tfrac{1}{2}J(1+f)RT3+\tfrac{1}{2}(1-f)LT3 = jRT3+0.4LT3 = \\ &(RT3\angle{+22.5°}+0.4LT3\angle{-67.5°})\angle{+67.5°} \end{aligned}$$

The back reproduced signals LB′ and RB′ are expressed by the following equations.

$$\begin{aligned} LB' &= \tfrac{1}{2}\{LT3-jRT3+b(LT3+jRT3)\} = \\ &\tfrac{1}{2}(1+b)LT3-\tfrac{1}{2}j(1-b)RT3 = LT3 - j0.4RT3 = \\ &(LT3\angle{+22.5°}+0.4RT3\angle{-67.5°})\angle{-22.5°} \end{aligned}$$

$$\begin{aligned} RB' &= \tfrac{1}{2}\{LT3-jRT3-b(LT3+jRT3)\} = \\ &-\tfrac{1}{2}j(1+b)RT3+\tfrac{1}{2}(1-b)LT3 = -jRT3+0.4LT3 = \\ &(RT3\angle{-22.5°}+0.4LT3\angle{+67.5°})\angle{-67.5°} \end{aligned}$$

It will thus be clear that the reproduced signals LF′, RT′, LB′ and RB′ of the type III system correspond to reproduced signals shown by equation (7) but phase shifted by +22.5°, +67.5°, −22.5° and −67.5° respectively.

As has been described above, the reproduced signals for respective systems obtained by the decoding apparatus of this invention have somewhat different phases from those obtained by the prototype decoding apparatus. However, such phase differences do not cause any serious troubles in four channel reproduction. Such phase differences may be compensated for by connecting to the first to fourth output terminals 22 to 25 phase shifters that can decrease such phase differences.

Figure 3:
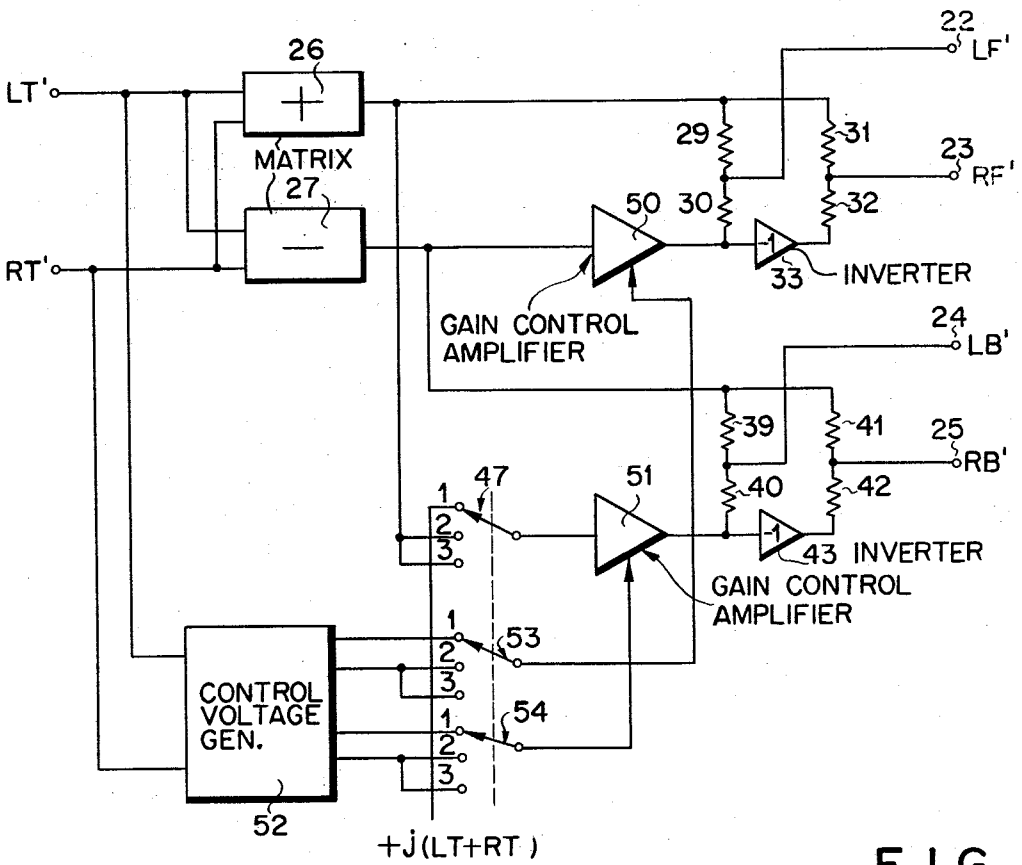
FIG. 3 shows another example of the signal combiner shown in FIG. 1.

Although in the embodiment shown in FIG. 2, voltage dividing resistors were used as the first and second amplitude level changing means, such means can also be provided by gain control amplifiers as shown in FIG. 3, wherein the bias voltages for the gain control amplifiers are varied to vary their gains in accordance with the type of the composite signals to be decoded. For example, for decoding of the type I system the gain control amplifiers 50 and 51 are set to have a gain of unity whereas for decoding of the type II and III systems the gain control amplifiers are set to have a gain of about 0.4.

To use the gain control amplifiers, it is advantageous to construct the decoder as a so-called vario-matrix decoder which produces four channel output signals while varying combining ratios of input composite signals while varying with instantaneous amplitude relationship between the directional audio input signals contained in the input composite signals to be decoded. To this end, as shown in FIG. 3, a control voltage generator which generates control voltage signals in response to an instantaneous amplitude relationship between respective audio signals contained in the composite signals LT and RT is connected to receive the third and fourth composite signals LT′ and RT′ which are applied to the signal combiner 21. The control signal generator 52 is constructed such that it discriminates the phase relationship between the input signals LT′ and RT′ or the amplitude relationship between the sum and the difference of the input signals LT′ and RT′ for generating the control voltage signals. The control voltage generator 52 may be constructed to generate the control signals in accordance with the type of the four channel system. The control voltage signals are selectively applied to gain control amplifiers 50 and 51 respectively through switches 53 and 54. The magnitude of the control voltage may be varied in accordance with the instantaneous amplitude level of the audio signals contained in the composite signals by taking as the reference a certain voltage level which sets the gains of the gain control amplifiers to unity or to about 0.4. The circuit elements shown in FIG. 3 which are identical to those shown in FIGS. 1 and 2 are designated by the same reference numerals so as to omit their descriptions.

While the invention has been shown and described in terms of specific embodiments thereof it should be understood that the invention is not limited to these specific embodiments and that many changes and modifications may be made without departing from the scope of the invention as defined in the appended claims.

What is claimed is:

1. A decoding apparatus for use in matrix four channel systems of different types comprising:

first and second input terminals adapted to receive first and second composite signals to be decoded respectively;

first to fourth output terminals from which first to fourth output signals are derived out;

first phase shifter circuit means coupled to said first input terminal for producing a third composite signal;

second phase shifter circuit means coupled to said second input terminal and having substantially the same phase shifting characteristic as said first phase shifter circuit means;

matrix circuit means having first and second inputs, the second input of said matrix circuit means being coupled to said second input terminal of said decoding apparatus, said matrix circuit means being operative to produce a sum of input signals when they are applied to said first and second inputs of said matrix circuit means;

first switch means coupled between said first input of said matrix circuit means and said first input terminal of said decoding apparatus for selectively coupling said first input terminal of said decoding apparatus to said first input of said matrix circuit means in accordance with the type of the first and second composite signals to be decoded;

third phase shifter circuit means coupled to the output of said matrix circuit means and having a different phase shifting characteristic from said first and second phase shifter circuit means;

second switch means for selectively deriving out an output signal from said second phase shifter circuit means and an output signal from said third phase shifter circuit means in accordance with the type of said first and second composite signals to be decoded to provide a fourth composite signal, said second switch means being adapted to selectively derive out the output signal from said second phase shifter circuit means as said fourth composite signal when said first switch means couples said first input terminal of said decoding apparatus to said first input of said matrix circuit means; and signal combining means adapted to generate first to fourth output signals on said first to fourth output terminals respectively by combining said third and fourth composite signals, when said first input terminal of said decoding apparatus is not coupled with said first input of said matrix circuit means and generate the first and second output signals on said first and second output terminals respectively by combining said third and fourth composite signals, and the third and fourth output signals on said third and fourth output terminals respectively by combining said third and fourth composite signals and a fifth composite signal which is produced by said third phase shifter circuit means when said first input terminal of said decoding apparatus is coupled to said first input of said matrix circuit means.

2. A decoding apparatus according to claim 1 wherein the phase shifting characteristic of said third phase shifter circuit means is different by about 90° from those of said first and second phase shifter circuit means.

3. A decoding apparatus according to claim 1 wherein said signal combining means comprises:

first means connected to receive said third and fourth composite signals for producing a sum signal thereof;

second means connected to receive said third and fourth composite signals for producing a difference signal thereof;

third means for additively and subtractively combining said sum signal and said difference signal to produce said first and second output signals;

fourth means for changing the amplitude level of said difference signal to be coupled to said third means in accordance with the type of said first and second composite signals to be decoded;

fifth means for additively and subtractively combining said difference signal with either one of said sum signal and said fifth composite signal in accordance with said first and second signals to be decoded to produce third and fourth output signals; and sixth means for changing the amplitude level of said sum signal to be coupled to said fifth means in accordance with the type of said first and second composite signals to be decoded.

4. A decoding apparatus according to claim 3 wherein each of said fourth and sixth means comprises a voltage divider.

5. A decoding apparatus according to claim 3 wherein each of said fourth and sixth means comprises a gain control amplifier means.

6. A decoding apparatus according to claim 1 wherein said signal combining means is a vario-matrix decoder which produces four-channel output signals while varying combining ratios of input composite signals in accordance with instantaneous amplitude relationship between the directional audio input signals in the input composite signals to be decoded.

* * * * *